United States Patent [19]

Blum et al.

[11] Patent Number: 4,974,391

[45] Date of Patent: Dec. 4, 1990

[54] AUTOMATIC PACKAGE LOADING SYSTEM FOR BAKERY GOODS AND THE LIKE

[75] Inventors: Richard J. Blum, Shaker Heights, Ohio; John C. Zimmermann, III, Darien, Conn.; Merrill N. Whye, Jr., Dallastown, Pa.

[73] Assignee: Blossom Industries, Inc., Cleveland, Ohio

[21] Appl. No.: 397,138

[22] Filed: Aug. 22, 1989

[51] Int. Cl.[5] ..... B65B 35/56; B65B 43/52; B65B 57/02

[52] U.S. Cl. ..... 53/69; 53/244; 53/250

[58] Field of Search ..... 53/244, 246, 245, 251, 53/250, 249, 536, 535, 531, 69, 67, 64

[56] References Cited

U.S. PATENT DOCUMENTS

| | | | |
|---|---|---|---|
| 3,509,688 | 5/1970 | Hartbauer et al. | 53/244 X |
| 4,010,595 | 3/1977 | Boyd | 53/250 X |
| 4,628,665 | 12/1986 | Herrington | 53/250 X |
| 4,915,368 | 4/1990 | Tsunekawa et al. | 53/250 X |

*Primary Examiner*—James F. Coan
*Attorney, Agent, or Firm*—Schweitzer Cornman & Gross

[57] ABSTRACT

A comprehensive system is disclosed for the pattern forming and loading of packaged bakery products into pallet trays or baskets (herein collectively referred to as baskets) for delivery to stores. An arrangement of basket and product conveyors delivers product packages to a pick-up station and baskets to loading positions. A programmable robotic loader is fitted with a special gripper adapted for the pick-up of groups of the packaged goods by applying suction to the product packages and physically laterally confining the suspended bags. The programmed loader picks up product groups and places them in a programmed, optimal pattern in the shipping basket. The special gripper mechanism enables the robotic loader to execute rapid translational and rotational motions in transferring product to the shipping baskets in a desired orientation. A unique form of continuously running, free roller conveyor delivers the product packages to the pick-up station, while isolating soft, compressible products from forward pressure from the conveyor. A novel arrangement of basket conveyors enables a single primary basket infeed conveyor to reliably supply a plurality of product loading stations with empty baskets for product loading. The primary conveyor is associated with a plurality of secondary conveyor sections, to which baskets are diverted on demand without significantly holding up the forward flow of empty baskets to other stations.

7 Claims, 5 Drawing Sheets

AUTOMATIC PACKAGE LOADING SYSTEM FOR BAKERY GOODS AND THE LIKE

BACKGROUND AND SUMMARY OF THE INVENTION

In the baking industry, products such as bread loaves, rolls and the like are produced in huge numbers. In general the processes of the baking industry are highly automated and mechanized, so that the huge volume of products can be produced and handled at reasonable cost.

One area of baking industry that has stubbornly resisted attempts to achieve effective automation is the handling of the packaged products. Notwithstanding substantial efforts to automate this aspect of bakery production, cost effective automation has been very elusive and the loading of packaged products has remained a highly labor intensive, and therefore costly phase of the operation.

In the production of bread and rolls, for example, it is typical practice to package many of the baked products in plastic bags. In the case of bread, a single loaf per bag is typical, while for rolls there may be a number of items per bag. The bagged products are then loaded into special low-sided shipping baskets or onto pallet trays. Typically, basket are formed of plastic material and are arranged to be self-stacking, when loaded with product, and at least partially nesting when empty. The trays typically are relatively flat and are designed to be stored and carried in racks when filled with product, so that the bakery products, which are typically quite soft, are not subjected to weight loading during storage and transportation. That is, in a vertical stack of loaded baskets, the weight of a loaded shipping basket is supported by the basket below. When using trays, loaded trays are support by the structure of a rack. For the purposes of this application, the term "basket" will be understood to refer generically to baskets, trays, or the like, unless the context indicates otherwise.

In the loading of the shipping baskets, several objectives must be observed. In general, it is desired to load as many product items into a basket as practicable, without excessively compressing the product. This typically involves a special pattern loading of the basket, with a certain number of product packages oriented in one direction and other packages oriented in another direction, etc. Thus each product type has an optimum loading pattern which must be followed. Additionally, it is necessary that each shipping basket loaded with products of the same type be loaded with an equal number of items. And finally, end-for-end orientation of the product packages is frequently important as where the product is contained in plastic bags with "tails".

In the bagging of bakery products, it is customary for the open end of a filled bag to be closed and tied by a clip or twist wire. This leaves a "tail" projecting from one end of the package. Bakers strongly prefer to orient the packages in the shipping baskets so that these tails are not positioned adjacent the side walls of the basket. The sidewalls of the baskets usually are very low, so that the package tails would be exposed, being both somewhat unsightly and also subject to being snagged. Accordingly, the consistent practice of the industry in the basket loading of packaged products is to orient the package tails to extend inwardly, away from the basket walls.

In a typical industrial bakery operation, the products being handled at the basket loading section are frequently changed, so that the various loading requirements mentioned above, i.e., number of packages, loading pattern, and tail orientation, are constantly changing. As a result, and notwithstanding a generally high degree of automation elsewhere through the baking operations, the basket loading tasks continue to be performed largely manually, in an arduous, labor intensive, and therefore costly manner.

Pursuant to the invention, however, a system is provided which enables the basket loading operations to be automated to a high degree, such that a wide variety of product types can be loaded into shipping baskets an a manner consistent with all of the objectives discussed above and at consistently high production rates. The improved system greatly reduces the labor requirements of the loading operation and permits more effective reassignment of the workers now designated for this task.

In accordance with one aspect of the invention, a novel and improved basket loading arrangement is provided which utilizes a conveyor system, for supplying empty shipping baskets to each of a plurality of load stations. A product conveyor system, for feeding product packages to a loading position adjacent the basket conveyor system, is provided at each load station. A programmable robotic loader is also located at load station. The loader includes a gripper mechanism which is both controllable through a main operating program and is also easily reconfigurable if necessary to accommodate major changes in product types. Each product conveyor system delivers product packages on a continuous basis and in a predetermined orientation, to a loading position. When a predetermined number of packages, forming a product group, is gathered at the loading position, the robotic loader grips the entire group and transfers it to a shipping basket held at a loading position on the basket conveyor system. By means of a pre-established program, determined for the specific product packages being handled at the time, the robotic loader executes a plurality of loading operations, in each case making a pick-up of a predetermined load group and placing the group in a specific predetermined pattern location in the basket. Where the product is packaged in bags with tails, the package placement is carried out with a predetermined orientation of the package tails. Upon a change of product type, the robotic loader is operated under a different tut pre-established program, perhaps with a load group of different number and with a different number and orientation of placements in the waiting shipping basket. In some cases, the gripper may have to be reconfigured, or the robotic loader may have to be fitted with an alternate gripper mechanism, preset for a specific new product type.

In accordance with another aspect cf the invention, an advantageous form of basket conveyor system is provided, which includes a primary conveyor for supplying empty shipping baskets to a plurality of load stations and a plurality of secondary conveyor sections, one for each load station. In conjunction with each secondary conveyor section there is a mechanism for selectively diverting baskets from the primary conveyor in accordance with demand. Desirably the principal conveyor mechanisms for both primary and secondary conveyors are slip conveyors, which are maintained in continuous operation. When baskets are held against movement, as for loading with product packages or for the diverting of baskets to a secondary conveyor section, the endless conveyor elements continue in motion and slip underneath the empty baskets.

A particularly advantageous form of means for diverting empty baskets to the secondary conveyor sections is a lift mechanism which straddles the line of the primary basket conveyor and includes a high friction belt conveyor section interposed between continuing sections of the primary conveyor. Lift elements at each side of the belt conveyor are adapted to engage the side edges of a basket and elevate the basket to the level of a secondary conveyor section. A pusher mechanism at the elevated level displaces the basket onto the surface of a secondary conveyor, which advances the basket toward a loading position. When a demand for an empty basket is signalled, the belt conveyor is stopped momentarily with a basket in proper position for lifting to the level of the secondary conveyor. While the belt conveyor is stopped, its high friction characteristics serve temporarily to hold up any upstream baskets being advanced by the primary conveyor. As soon as the basket has been lifted from the belt conveyor, its operation, and the continuing flow of empty baskets along the primary conveyor, is resumed. The primary conveyor is, of course, operated at sufficient speed to enable it to supply baskets to a plurality of load stations.

In accordance with another aspect of the invention, a novel form of product supply conveyor is provided, which enables the soft bakery products to be delivered to a loading position and collected in predetermined load groups, to be successively picked up by the robotic loader. The product conveyor is a free-roller type of conveyor, in itself known, in which the conveyor surface is made up of closely spaced rollers supported for free rotation on individual shafts. The shafts are carried by spaced conveyor chairs. The soft bakery products placed on the conveyor are advanced successively toward the loading position. A stop element engages the first package of a group, and the others stack up behind as the roller elements of the conveyor roll underneath the stopped packages. When a complete load group has been delivered to the loading position, indicated by signals from photocells or other sensor devices, a brake element engages the upper surfaces of the rollers in the region of the load group, forcing the rollers to reverse rotate so that the forwardly advancing rollers impart no forward pressure to the collected package load group. This avoids any crushing of the soft bakery products by residual forward pressure resulting from friction of the rollers, as the product conveyor continues to operate while the load group is waiting to be picked up by the robotic loader.

A still further feature of the invention is the provision of a novel and improved form of product gripping mechanism, adapted for the pickup of a complete load group of packages and the placement thereof in a shipping basket. The gripping mechanism includes a frame on which are supported a plurality of downwardly projecting soft suction devices. The suction devices can be movably positioned for optimum placement with respect to the several packages of a load group and are selectively actuated in accordance with operations of the robotic loader. To advantage, the gripper mechanism includes pivoting side retainers for lateral confinement of the product packages during rotary and translational movements of the gripper during transfer of the packages from the load position on the product conveyor to the shipping basket being loaded. The side retainers may also serve to compress the soft product laterally as necessary to accommodate its placement in the waiting basket.

For a more complete understanding of the above and other features and advantages of the invention, reference should be made to the following detailed description of a preferred embodiment of the invention and to the accompanying drawings.

DESCRIPTION OF PREFERRED EMBODIMENTS OF THE INVENTION

Figure 1:
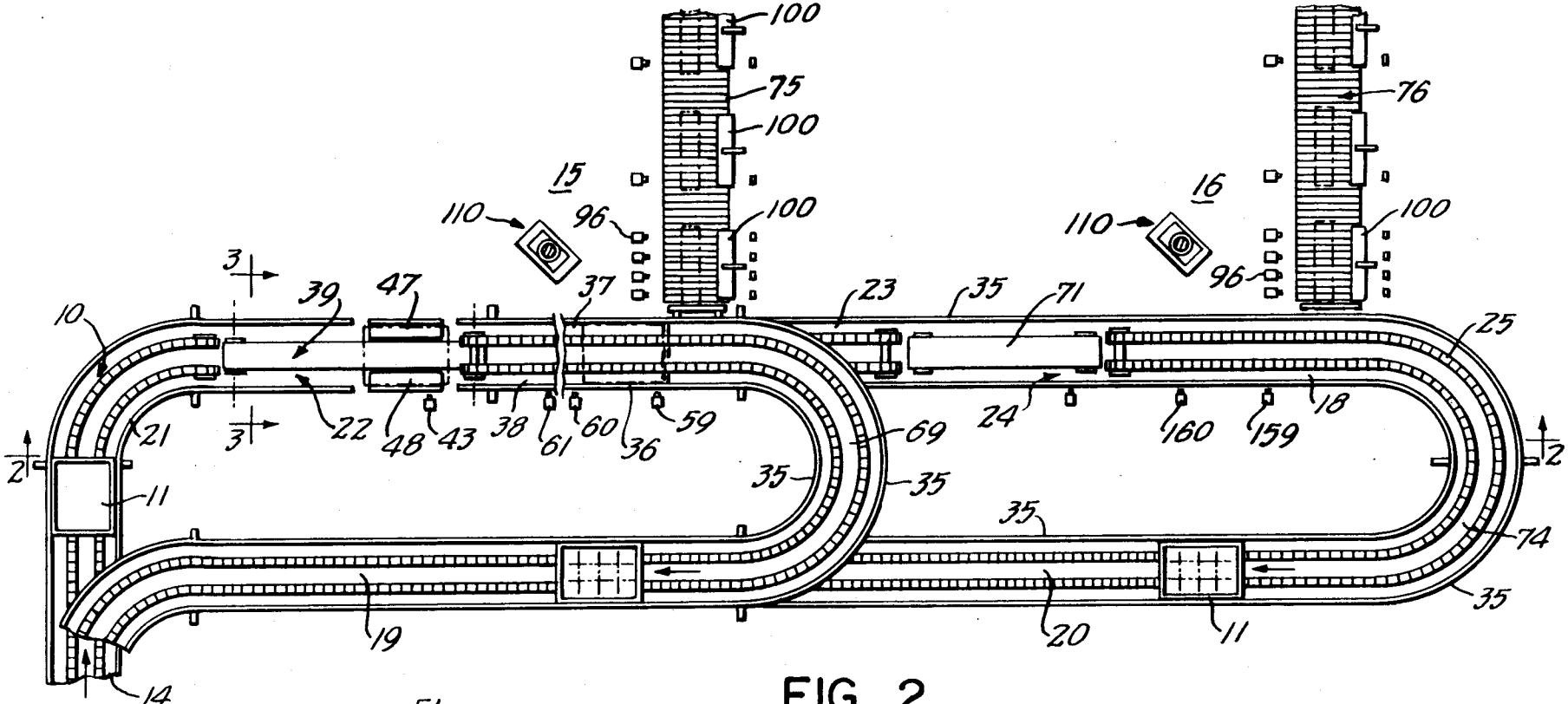
FIG. 1 is a top plan view of a simplified version of a system according to the invention for the automated loading of bakery products into shipping baskets at two load stations.
Figure 2:
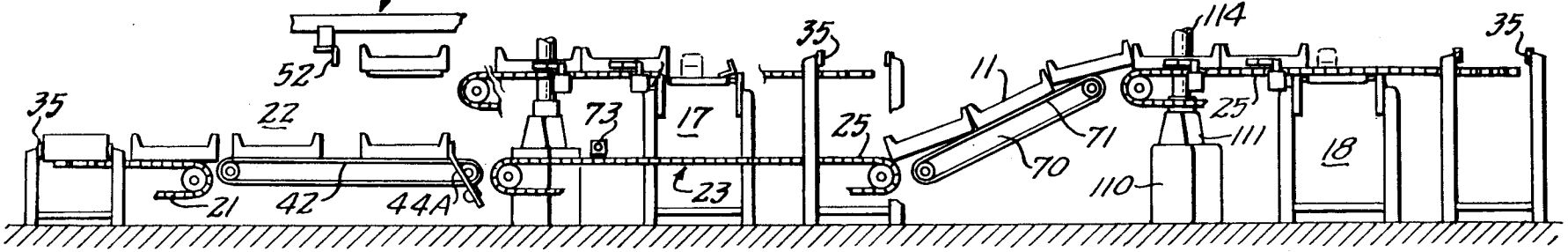
FIG. 2 is a cross sectional view as taken generally along line 2—2 of FIG. 1.
Figure 4:
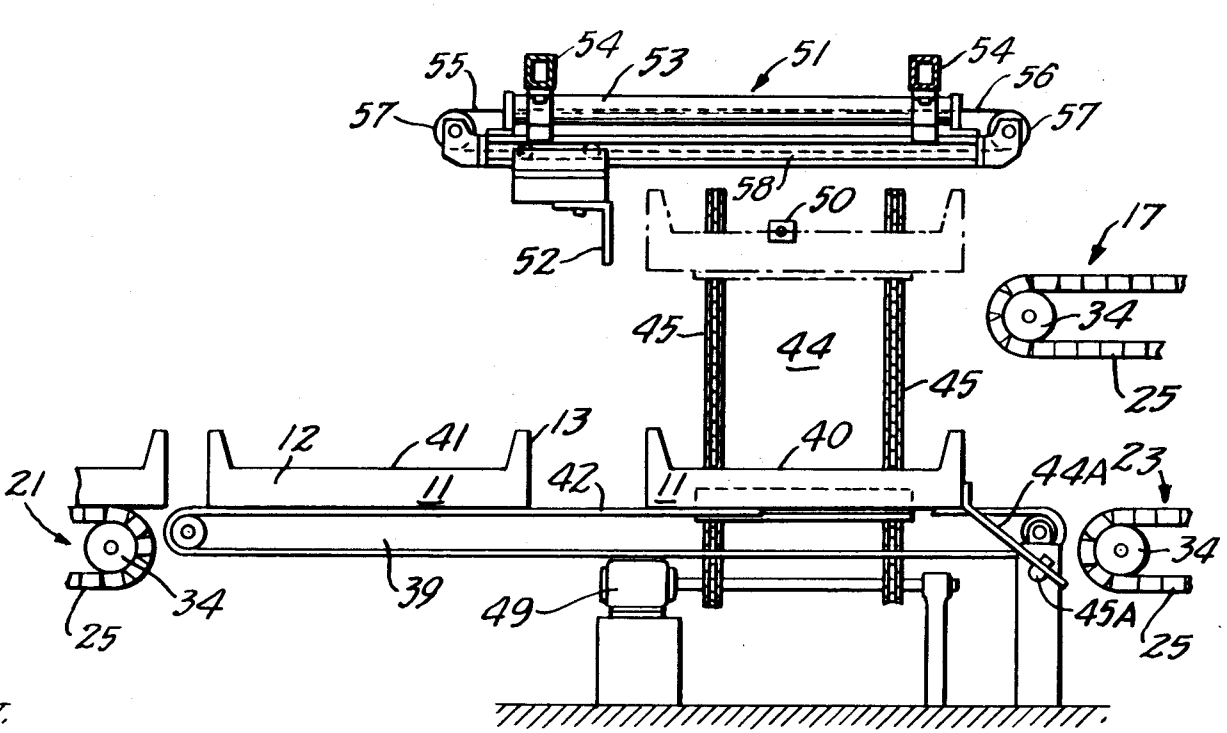
FIG. 4 is a cross sectional view as taken generally along line 4—4 of FIG. 3.

Referring now to the drawings, and initially to FIGS. 1 and 2 thereof, the reference numeral 10 designates generally a primary conveyor for delivering empty shipping baskets 11. The baskets are of conventional design and construction, being formed of structural plastic and typically having relatively low side walls 12 and relatively higher end walls 13 (FIG. 4). (Trays, where utilized, are also generally formed of structural plastic and have a peripheral arm extending around a flat surface that carries the product.) In the illustrated system, the primary basket conveyor is arranged to receive baskets at its upstream end (not shown, but designated representationally at 14.

In the illustrated system, there are two load stations, generally designated 15 and 16, at which packaged products are supplied for loading into the empty baskets. At each load station there is a secondary conveyor section 17, 18 which is arranged to receive empty baskets diverted from the primary conveyor system and for processing the baskets during and after loading with product. Each secondary conveyor section includes a discharge or return section 19, 20, by means of which the filled baskets are conveyed to discharge points, where they are loaded onto racks, or perhaps directly into waiting trucks. It will be understood, of course, that the primary line may supply more than two product load station, but two will suffice to illustrate the principles of the invention.

In the illustrated system, the primary conveyor comprises an upstream section 21 and an intermediate section 23. The upstream section extends from the basket on-loading area (not shown) continuously to a first diverter station 22. The intermediate section 23 discharges onto a second diverter station 24. If additional load stations are provided, there will be additional intermediate sections of the primary try conveyor and additional diverter sections for the load stations, with a limiting factor being the rate at which incoming empty baskets may be supplied without interruption at the several load stations.

Figure 6:
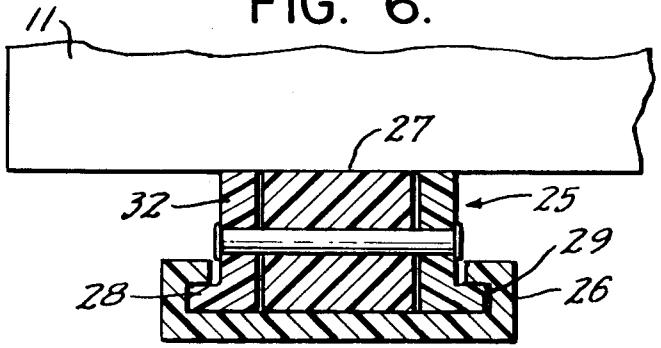
FIG. 6 is an enlarged cross sectional view as taken on line 6—6 of FIG. 5.
Figure 3:
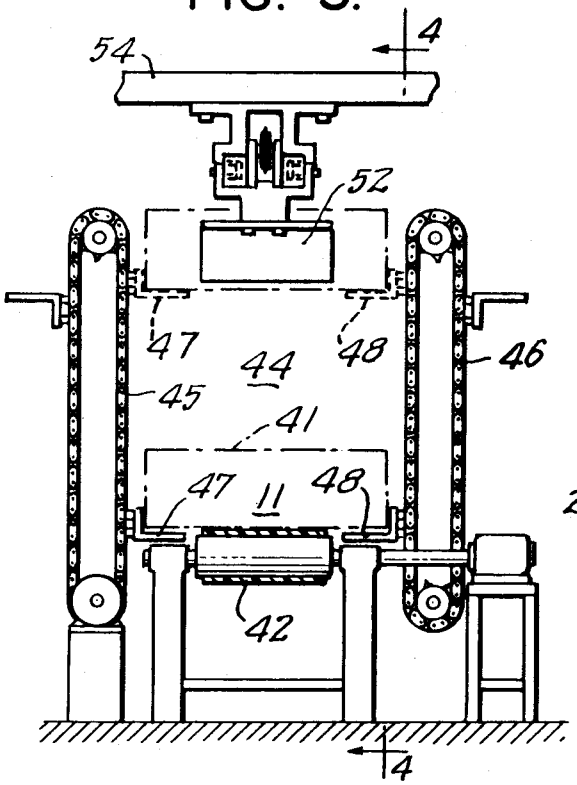
FIG. 3 is an enlarged cross sectional view as taken generally on line 3—3 of FIG. 1.
Figure 5:
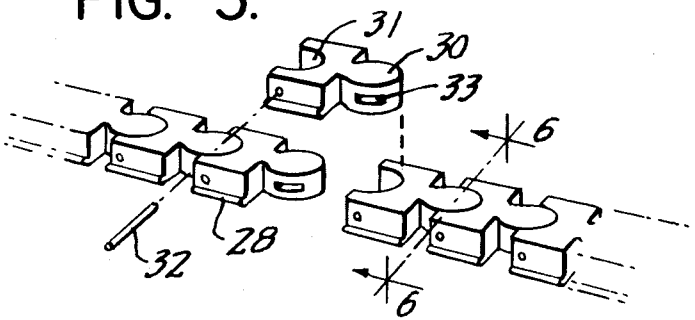
FIG. 5 is a fragmentary perspective view showing details of endless chain elements used in the construction of conveyor means for moving baskets throughout the system.
Figure 8:
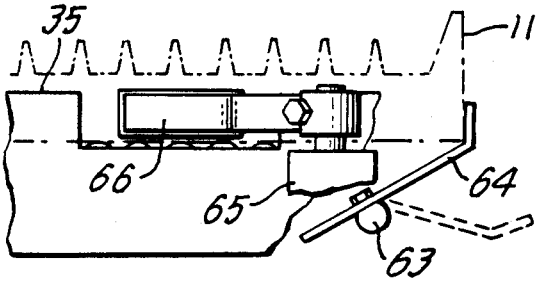
FIGS. 8 and 9 are fragmentary cross sectional views as taken generally on lines 8—8 and 9—9 respectively of FIG. 7.

To advantage, the primary and secondary basket conveyors are comprised of a pair of spaced, endless conveyor chains 25 (see FIG. 7), which are guided in grooved plastic tracks 26 and form a support surface 27 (FIG. 6) for the baskets 11. The chains 25, in themselves not part of the invention, are formed of a structural plastic material, such as nylon. The individual links, shown in FIG. 5, are flanged along the bottom at 28 for guided reception in recesses 29 in the guide tracks 26, also formed of a structural plastic such as nylon. Each link has a circular head 30 received in a circular recess of smaller included angle to accommodate horizontal rotation. Successive links are connected by pins 32 fixed in the body of a leading link and passing through a specially contoured slotted opening 33 in the head of a trailing link, so that both vertical and horizontal rotation is accommodated. The chains are directed around sprockets 34, either idlers or drivers as appropriate at a given location. Between the sprockets the chains are guided by the tracks 26. All of the sections 21, 23 of the primary basket conveyor are driven in synchronism and, for the most part, are constantly in motion. The plastic material of the chain links has a low friction drive relationship with the baskets 11 such that, if baskets are stopped near the downstream end of the conveyor, as is desired at times pursuant to the invention, the conveyor chains will continue in motion and will slip underneath the stopped baskets while baskets further upstream on the conveyor will continue to be carried until they stack up against stopped baskets in front cf them. Of course, if an excessive number of baskets become stacked up, indicative of a system malfunction, a sensor element (not shown) located near the upstream end of the primary conveyor, sensing the continued presence of a stopped basket, will shut down the primary conveyor system pending correction of the malfunction.

As shown in various views, both the primary and secondary conveyor sections include spaced side walls 35. These extend substantially continuously throughout the entire length of each conveyor section to guide the baskets along their predetermined paths.

With reference to FIGS. 2–4, 7 and 8, there are shown details of one of the secondary conveyor section 17 and the associated diverter station 22. In the illustrated arrangement it is convenient to place the upstream end portions of the secondary conveyor 17 at a higher level than and directly above the primary conveyor (see, for example, FIG. 2). The upstream end of the secondary conveyor has enough length to form a load station 36, holding a basket for loading with product, a staging position 37 holding the trailing basket, and a reservoir 38 for holding one or more additional baskets.

Immediately adjacent the upstream end of the secondary conveyor 17 is the diverter station 22 which in the illustrated case is an advantageous form of lift mechanism. This mechanism, shown particularly in FIGS. 3 and 4 and which may be referred to generally by the numeral 22, includes a belt conveyor section 39, which is interposed between the upstream and intermediate sections 21, 23 of the primary basket conveyor. The belt conveyor section is of sufficient length to hold one basket 40 in a lift position and at least part of and preferably all of a trailing second basket 41. The belt 42 is of a material, such as rubber, which has significant frictional gripping characteristics with the bottoms of the baskets. The belt conveyor 39 is driven at a slightly higher rate of speed than the chains 25 of the primary conveyor, so that the empty baskets 11, as they are engaged by the upstream end of the conveyor belt 42, are accelerated away from the baskets trailing them, assuring that there will be a& least some space between adjacent baskets while moving over the belt conveyor.

If the secondary conveyor section 17 cannot accept an empty basket, the baskets simply pass over the belt conveyor 39 and are discharged onto the upstream end of the intermediate section 23 of the primary conveyor. However, if the control system indicates the capacity to receive a basket, the next basket 40 that arrives at a lift position, as detected by a photocell 43 (FIG. 1), causes stop arms 44 to be pivoted upward by a rock shaft 45 into a blocking position in front of the basket 40. The basket-to-basket spacing provided by the accelerated belt conveyor provides space for the stop arms to be lifted without interfering with the basket in front. The signal from the photocell 43 also causes the belt conveyor 39 is also stopped momentarily, leaving the basket 40 in the lift position and the basket 41 trailing it in a blocking position to hold back baskets that continue to be advanced by the still-operating primary conveyor.

The photocell 43 also actuates a basket lift 44, which comprises spaced pairs of lifting chains 45, 46 to which are secured L-shaped lift brackets 47 48 arranged in opposed pairs. Prior to actuation of the photocell, a pair of brackets 47, 48 is positioned in straddling relation to the upper level of the belt 42, extending under opposite side edge margin of baskets being carried over the belt conveyor. When the belt conveyor is stopped, a pair of the lift brackets is under the basket 40 in the lift position. After a momentary delay, to allow the basket 40 to be positioned against the stop arms 44, the lift chains are actuated, as by a geared drive motor 49, and the basket is elevated to a level even with the drive chains 25 of the secondary conveyor section 17. When this level is reached, as determined by a photocell 50, the lift drive is stopped. The lifted basket remains supported by its lift brackets 47, 48, however, until the control system for the secondary conveyor system 17 calls for the basket.

When the secondary conveyor 17 calls for a basket, a pusher mechanism 51, forming part of the lift mechanism 22, is actuated to advance forwardly a pusher bracket 52. The bracket 52 engages the back wall of the elevated basket and pushes it forwardly onto the chains 25 of the elevated secondary conveyor section 17, which are continuously in motion. The pusher mechanism comprises an elongated fluid cylinder 53 mounted on frame members 54 of the lift mechanism 22. The cylinder houses a movable piston, not shown, connected on each side to cables 55, 56. The cables are trained about sheaves 57 and are attached to the pusher bracket 52, so that movements of the internal piston are translated into forward or rearward movement of the bracket 52. The bracket 52 is guided by a grooved track 58 mounted in fixed relation to the cylinder 53.

After the basket 40 at the lift position is elevated by the basket lift, the stop arms 44 are retracted and the belt conveyor 39 is restarted to continue delivery of empty baskets to all load stations downstream (in the illustrated case only the final load station 16). These operations may be initiated as soon as the lifted basket 40 clears the top of basket 41 trailing it, and thus can be controlled by the photocell 43 used to detect the presence of a basket at the lift position.

The movement of baskets on the secondary conveyor section 17 is controlled principally by a plurality of photocells 59, 60 and 61 (see FIGS. 1 and 10) mounted at positions corresponding respectively to the load station, the staging position and the reservoir section. The last mentioned photocell is located so as to be blocked when a basket occupies the upstream limit position in the reservoir, indicating that the conveyor section can receive no more baskets. Any time the photocell 61 is clear, the pusher mechanism is activated (subject, of course, to there being an elevated basket in the basket lift) to push a basket onto the conveyor. Since the conveyor is continuously running, the pushed basket is immediately advanced by the conveyor until it reaches the load station (if the conveyor section 17 is entirely empty) or until it is stacked up against a basket stopped .n front. The lift mechanism, now signalling the absence of a basket in the elevated position, will immediately be actuated to lift up the next basket from the primary conveyor, as described above, and this process will repeat until the secondary conveyor section is filled with baskets from the load position, in front, to the elevated position in the lift mechanism, at the rear.

When an empty basket on the conveyor section 17 reaches the loading position, the photocell 59 is blocked. This actuates a rotary actuator 62 (FIG. 7) to rotate a rock shaft 63, lifting a plurality of stop arms 64 into blocking position to stop the basket at an accurately predetermined load position. In addition, after a momentary delay, a rotary actuator 65 is activated to pivot a basket clamp 66, hereinafter referred to as the loading clamp, into pressure-bearing relation against the side wall of the basket, so that the basket is held immovably in the loading position, not only by the stop arms 64, which prevent forward movement, but also by the loading clamp, which prevents any movement at all and thus assures that the basket will remain accurately positioned throughout a series of operations of the robotic loader, as will be further described.

After an empty basket has been stopped and clamped in the loading position on the secondary conveyor section 17, the next basket along will engage the back of the first and be stopped thereby. In addition, the photocell 60 will be blocked, and this causes a rotary actuator 67 to bring a clamp arm 68, hereinafter called the staging clamp, into pressure bearing relation with the side wall of a basket in the staging position, i.e., immediately behind a basket in the loading position. The basket in the staging position is thus initially stopped by the basket ahead and then firmly clamped by the staging clamp 68.

As the primary basket conveyor 14 continues to supply empty baskets, baskets will continue to be diverted by the lift mechanism 22 and pushed onto the conveyor 17 until the photocell 61 signals no more capacity to receive. All of the baskets upstream of the staging position arm held back by being stacked up behind the basket clamped at the staging position while the conveyor chains continue to run underneath, slipping against the bottom surfaces of the baskets.

The filling of a basket with product at the loading position, to be described later, proceeds is soon as a basket arrives at that position, assuming of course that product packages are waiting on the associated product conveyor. The robotic loader eventually signals the completion of the loading operations. This activates the rotary actuators 62 and 65 to retract the stop arms 64 and release the load clamp 66. The loaded basket is instantly accelerated and carried away by the continuously moving conveyor chains 25. In the specific system illustrated herein, the secondary conveyor section 17 includes a semi-circular return section 69, which directs the loaded basket back toward the track of the incoming track or the primary conveyor via the discharge section 19. From there, the conveyor discharge section 19 leads back to the truck loading area (not shown) of the bakery plant, conveniently using the same vertical space as the incoming primary basket conveyor 14 for some or all of the distance involved.

The control signal that releases the load clamp 66 and frees the just-loaded basket operates with a slight delay, preferably less than one second, to release the staging clamp 68. That frees the basket in the staging position and all baskets stacked up behind it to advance one basket position. By reason of the slight delay between release of the loading clamp 66 and the staging clamp 68, a slight gap is provided between the loaded basket and the one behind, to enable the stop arms 64 to be raised to the stop position in time to stop the next empty basket at the loading position but without interfering with the loaded basket which is moving away.

In a system of more than two load stations, it is contemplated that the secondary conveyor sections for at least those load stations upstream of the last one could advantageously be constructed along the lines of the conveyor section 17, conveniently using a lift mechanism to elevate diverted baskets to the level of an elevated secondary conveyor. For the last station, however, it may be sufficient simply to use an inclined belt conveyor section instead of a somewhat more complicated lift mechanism, inasmuch as the primary conveyor terminates at the last load station.

With reference to FIGS. 1 and 2, the secondary conveyor section 18 for the last load station includes an inclined belt conveyor section 70 the belt 71 of which is formed of a material, such as rubber, having relative high friction gripping with the bottoms of the empty baskets 11. The lower end of the inclined conveyor is level with the discharge end of the last section 23 of the primary basket conveyor, and the upper end of the belt conveyor is even with the elevated level of the chains 25 of the secondary conveyor section 18.

The secondary conveyor section 18 includes basket positioning equipment which largely duplicates that for the conveyor section 17 described above. This includes photocells 159 and 160, corresponding in all respects to the photocells 59, 60 of the conveyor section 17, for controlling stop arms and loading and staging clamps (not shown in FIGS. 1 and 2 but in all respects similar to those elements shown in FIGS. 7 and 10). A third photocell 72 is located near the top of the belt conveyor 70. When this photocell is blocked, and the other photocells 159, 160 are also blocked, it is indicated that the conveyor section 18 has no further capacity to receive empty baskets, and the belt conveyor 70 is stopped. Baskets continue to be fed by the primary conveyor section 23, however, which remains running. Baskets fed by the section 23 are stopped upon engagement with the belt 70, or a basket already stopped in front.

Empty baskets are permitted to stark up on the primary conveyor section until a photocell 73 (FIG. 2) is blocked for a time, for example three seconds, indicating that the storage capacity of the conveyor section 23 has been filled. When this occurs, then as soon as an empty basket arrives at the lift position of the lift mechanism 22, the stop arms 44 of the lift mechanism are raised and the belt conveyor 39 is stopped, whether or not a basket is being called for by the secondary conveyor section 17. In other words, the stop arms 44 and belt conveyor 39 are used simply to hold back baskets from advancing to the primary conveyor section 23. Since &he primary conveyor continues to operate, incoming empty baskets are permitted to stack up upstream of the belt conveyor 39, as long as the total basket capacity of the incoming conveyor is not reached. Should that happen, the line is shut down and an alarm is sounded, calling attention to a malfunction.

As in the case of the secondary conveyor section 17, when a basket at the load position of the conveyor 18 has been filled, the robotic loader for that position signals that fact, and the filled basket is released, follow momentarily by the basket at the staging position. The illustrated conveyor section 18 is shown in FIG. 1 to have a semi circular return section 74 directing the conveyor back toward the line of the incoming primary conveyor 14 via the discharge section 20. In the illustrated system, the two conveyor discharge sections 19, 20 are supported at different vertical levels from each other and from the incoming primary conveyor section 21 so that all three can share the same vertical space. That arrangement, however, while convenient for many installations, is by no means essential.

Figure 7:
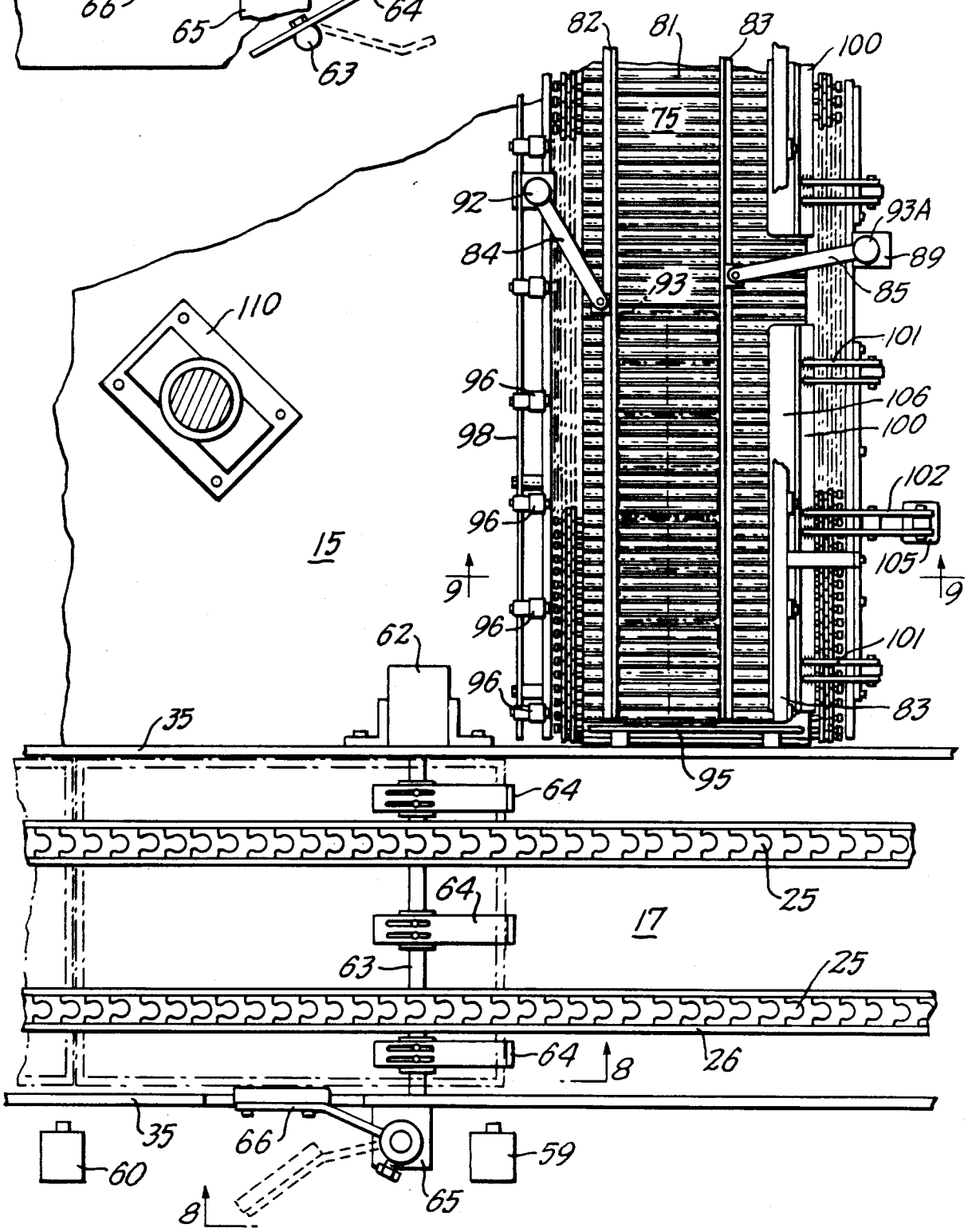
FIG. 7 is an enlarged, fragmentary top plan view of a load station area, illustrating features of the product and basket conveyors.
Figure 9:
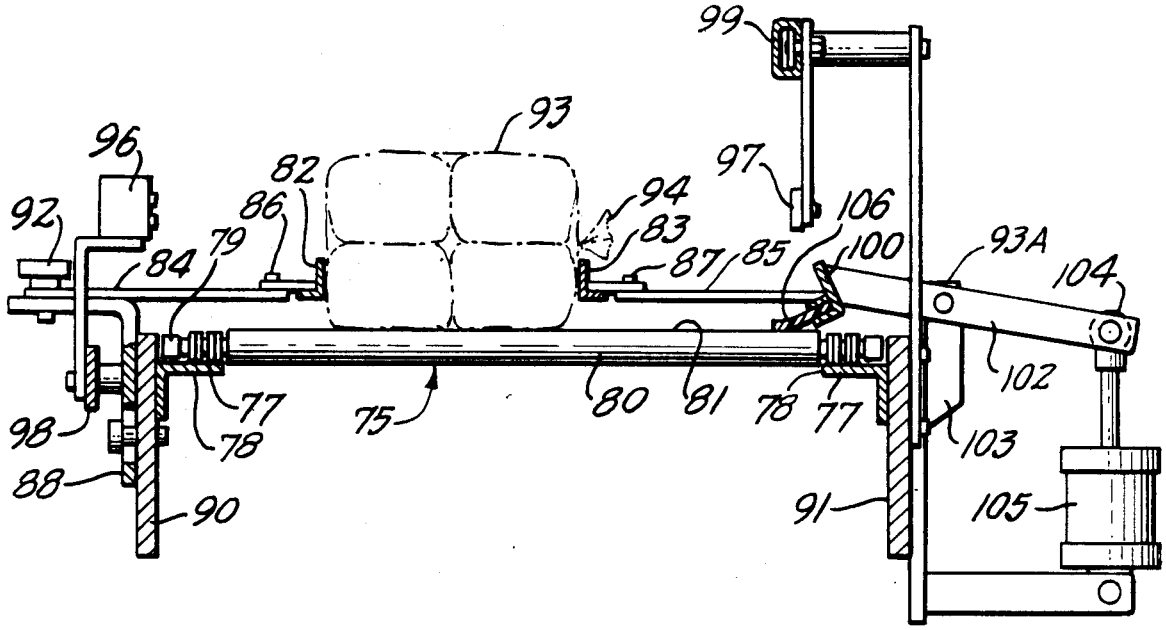
Figure 10:
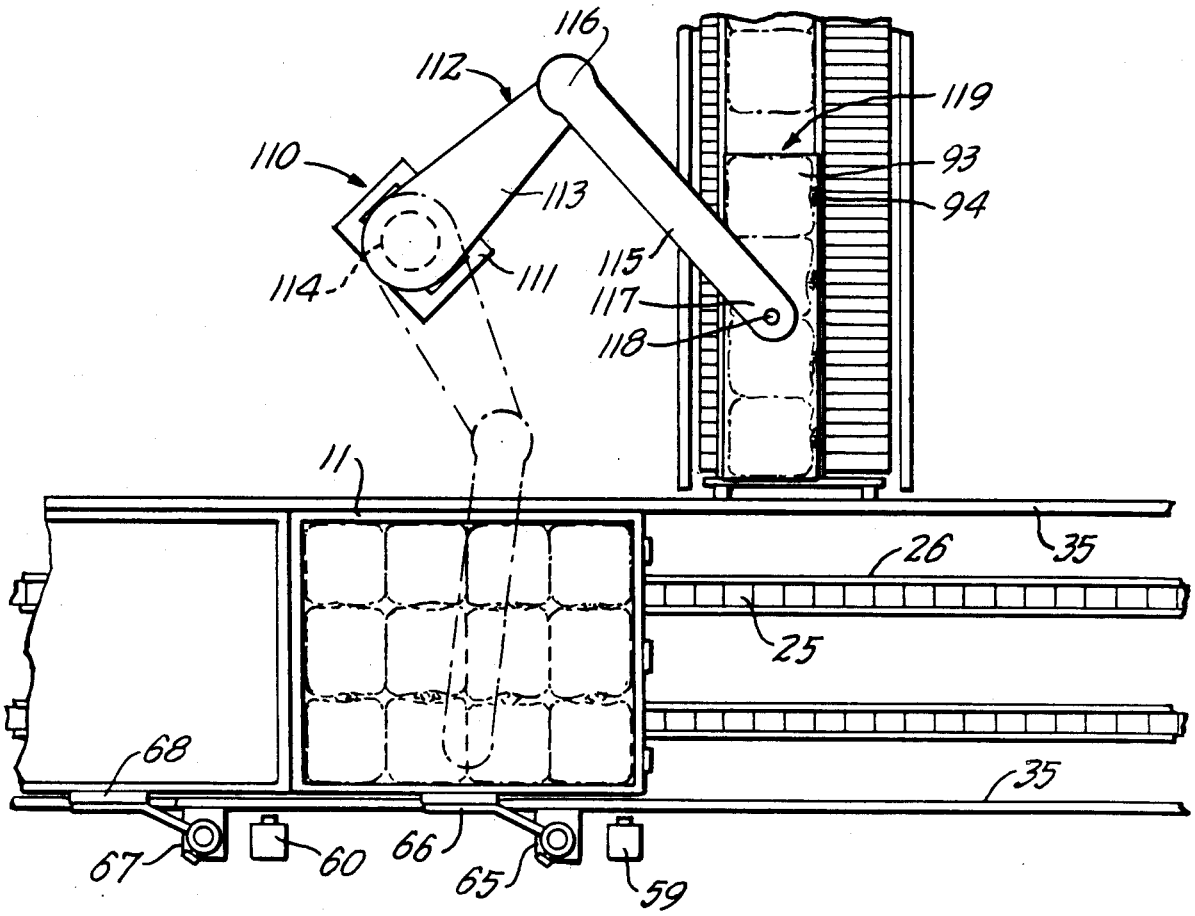
FIG. 10 is a top plan view, similar to FIG. 7, showing the operation of the robotic loader in transferring load groups from the product conveyor to a shipping basket.

In the illustrated system there are two product conveyor systems, which are designated generally by the reference numerals 75, 76. These are associated with the load stations 15, 16, respectively, and both may be of the same construction, so that only one of the product conveyor systems (75) will be specifically described. Details of the product conveyor systems are best shown in FIGS. 7, 9 and 10.

Fundamental to the product conveyor is the use of a free roller conveyor mechanism, which comprises a pair of spaced endless chains 77, supported by brackets 78. The chains 77 carry a series of shafts 79 arranged in closely spaced, parallel relation. On each of the shafts 79 is carried a cylindrical roller 80, arranged to be freely rotatable on the shaft. As shown best in FIG. 7, the spacing of the shafts 79 is sufficiently close that adjacent rollers are separated by only a small space, sufficient to permit free rotation of the rollers on their respective shafts. The chains 77, 78 are trained about sprockets (not shown) at each end, to form a conveyor of predetermined length, and the shafts and rollers are installed throughout the entire length of the chains, so that an effectively continuous working surface 81 of the conveyor is formed by the upwardly facing surfaces of the rollers. As a practical matter, only the uppermost surface portions of the rollers form effective support areas, so that product carried by the working surface 81 of the product conveyor is supported in spaced apart, transversely extending areas by a plurality of adjacent rollers 80.

Extending along the upper surface 81 of the product conveyor are spaced guide rails 82, 83. These are adjustably mounted by means of arms 84, 85, pivotally connected at 86, 87 to the guide rails and adjustably mounted on brackets 88, 89. The brackets are in turn carried by side rails 90, 91 forming part of the main frame structure of the conveyor. Typically, each guide rail is supported by two sets of the pivoting arms 84, 85, and manual tightening screws 92, 93 are provided to enable the rails to be quickly and easily adjusted as necessary to accommodate different sizes and types of product packages. At the upstream end (not shown) of the product conveyor 75, the guide rails 82, 83 may be somewhat divergent to facilitate initial entry of the packages into the confined path defined by the rails. In the downstream regions of the conveyor, the guide rails are substantially parallel.

Pursuant to the invention, the guide rails are set up to rather closely guide and confine product packages being advanced by the conveyor 75. For purposes of illustration, the product packages 93 shown in FIG. 7 are packages of buns, arranged eight to a package in two layers of four. It is to be understood, however, that the product packages are of a vide variety of sizes and shapes, and the width adjustment and side-to-side positioning of the guide rails can be set for each, so that the product packages delivered by the conveyor will be optimally aligned and arranged on the conveyor for loading into baskets. In the illustrated set-up, guide rails are provided for only a single row of product packages However, it will be understood that arrangements may be provided for supplying product packages in two or more side-by-side rows, where the size and shape of the packages permits.

Desirably, when the product packages, received from the bagger, are loaded onto the product conveyor at the upstream end, the package "tails" 94 are oriented in the same direction. This allows the tails to be controllably oriented in the proper direction in the baskets during the basket loading operations.

The product conveyor, like the basket conveyors, is generally driven constantly. Accordingly, product packages loaded on at the upstream end will advance until stopped by an obstruction, which may be the barrier bar 91 or another stopped package, or by other means.

At the downstream end of the product conveyor there is a stop rail 95 which forms a barrier for the front-most package on the conveyor. When a package engages and is stopped by the barrier, the conveyor can continue its forward motion by reason of the free rotation of the rollers 80, which roll underneath the stopped package as other packages continue to be advanced toward the front of the conveyor.

For each type of product package, there is a predetermined "load group" of packages which is collected at a loading position at the front of the conveyor. When the load group is ready, it can be picked up and transferred by the robotic loader. In the illustrated arrangement, the load group consists of four packages, and the presence of these packages is determined by means of a series of photocells 96, which are mounted along one side of the product conveyor and which cooperate with reflectors 97 mounted on the opposite side. The presence of a package is indicated by its blocking of a photocell.

In order to accommodate a variety of package types, the photocell devices and reflectors are mounted for easy upstream-downstream adjustment along rails 98, 99. As many photocells as desired may be provided, in order to insure accuracy and to provide for the control of several package groups along the working surface 81 of the conveyor.

Pursuant to one aspect of the invention, provisions are made for relieving forward pressure on packages advanced to the loading position and forming a load group. While the rollers 80 freely rotate on their shafts, and thus will roll underneath the stopped packages, both the friction of the rollers and the fact that they must be accelerated from rest to a reversely rotating, rolling condition causes forward pressure to be exerted on the package group. Because of the very soft and easily compressible character of many bakery products, even this limited forward pressure can be deleterious. Accordingly, when the presence of a full load group is indicated by the photocell sensors 96, the rollers in the region of the load group are independently caused to reverse rotate, so that the forces required to generate such reverse rotation are effectively isolated from the packages.

Extending along one edge margin cf the product conveyor, in the region of the load position, is a brake bar 100, which may be in the form of an angle bar. The brake bar is mounted by a pair of spaced support arms 101 and a central support arm 102, all pivoted on brackets 103 mounted on the frame of the conveyor. The central arm 102 has an extension, which is connected at 104 to a fluid actuator 105. A flexible strip 106 is carried by the angle bar and projects outwardly therefrom as shown in FIG. 9.

When the photocells 96 signal the completion of a load group at the loading position, the actuator 105 is operated to pivot the brake bar 100 downward, pressing the flexible strip 106 against the tops of the rollers underlying it. The rollers 80 contacted by the strip are forced by the strip to reversely rotate as the shafts carrying the rollers continue to be moved forwardly by the moving chains 77. As a result, the packages collected at the load position "see" no relative motion of the upper surface areas of the rollers 80 and are accordingly isolated from any pushing forces from the rollers. The brake bar actuator 105 will remain extended until the load group of packages is picked up and removed by the robotic loader. Removal of the packages clears the photocells and signals the actuator 105 to retract. The rollers in region of the loading position are thus freed to enable them to carry a new set of packages into the loading position.

As reflected in FIG. 1, the product conveyors, depending on length, may be provided with a plurality of brake bar mechanisms and associated photocell controls, whereby additional package groups may be assembled upstream of the loading position and held in a waiting status without being subjected to forward pressure from the moving rollers 80. When a load group is removed from the loading position by the robotic loader, all of the brake bars are released, enabling the several groups of packages to be advanced forwardly on the continuously running conveyor.

Near their upstream extremities, the product conveyors are provided with photocell sensors (not shown), the blockage of which signifies that the conveyor has no more capacity to accept packages. This would be indicative of a system malfunction and will cause an alarm to be sounded.

The robotic loader apparatus utilized in the system of the drawings is advantageously a commercially available Bosch or other suitable programmable loader 110, one at each load station, positioned adjacent the product and secondary basket conveyors 75, 17 where the two conveyors meet. In general, the loader 110 comprises a base 111 mounting an articulated arm mechanism 112. The articulated arm 112 includes an inner arm 113 mounted from the base 111 by means of a vertical shaft 114. The arm 113 is programmably rotatable about the vertical axis of the shaft 114.

An outer arm 115 of the articulated arm assembly is pivotally mounted at the outer end of the arm 114, for rotation about a vertical axis 116. The arm 115 is also programmably rotatable about its support axis 116, so that the outer end 117 of the outer arm may be controllably positioned at any location within the maximum and minimum physical limits of the loader.

The outer end 117 of the articulated robot arm 112 carries a depending vertical shaft. By means (not shown but part of the commercial Bosch robot mechanism) the shaft 118 is programmably rotatable and vertically movable. At its lower end, the shaft 118 carries a gripper mechanism 119, to be further described, which is capable of gripping and lifting a complete load group of product packages 93 from the loading position on the product conveyor 75. In the example illustrated in FIG. 10 the load group consists of four packages 93, each consisting of eight buns contained in a plastic bag.

In the arrangement shown in FIG. 10, the loading of a standard bakery basket at the loading position of the conveyor section 17 would require three operations of the loader 110. In each operation, a load group of four packages in placed in longitudinal orientation in the basket. In the first operation, the loader, summoned by a signal from the photocells 96 indicating the presence of a complete load group at the pick-up station, manipulates the arms 113, 115 and the shaft 118 to position the gripper mechanism over the product group. In this respect, the location of the pick-up station is pre-programmed into the loader, so that it automatically returns to the same position each time, with the gripper mechanism properly oriented to descend upon the product load group for a pick-up.

In the first of three loading operations, the pre-programmed loader first lifts the gripper, and the product group held thereby, and swings the gripper mechanism over the empty basket at the loading position. The gripper is oriented to align lengthwise of the basket and is lowered into the basket, initially along one side, for example the side nearest the loader. The orientation of the gripper is such that all of the package tails 94 are located on the side opposite the side wall of the basket. The loader then returns to the pick-up station to pick up a second load group.

The pick-up of the second load group is performed exactly the same as the pick up of the first group. However, the programmed deposit of the second load group is different because the gripper must go to a different location, for example to the center row of the basket. The orientation of the tails in the center row is immaterial, and so it is done in a manner requiring the least acceleration of the gripper. For the third loading operation, however, orientation of the package tails must be away from the outer wall of the basket, and so the gripper must be rotated 180° from the orientation used for the first placement.

As soon as the robotic loader has placed the third load group in the basket, the loader control program issues a signal that loading is complete, and the loaded basket is released. This is accomplished, as heretofore described, by lowering the stop arms 64 and releasing the loading clamp 66. The already moving conveyor chains 25 immediately accelerate the loaded basket and convey it to a discharge area elsewhere in the plant.

Figure 15:
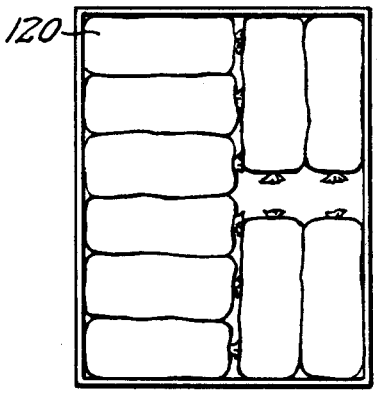
FIG. 15 is a representative example of an alternative form of pattern loading of bakery product into a shipping basket as is accommodated by the system of the invention.
Figure 12:
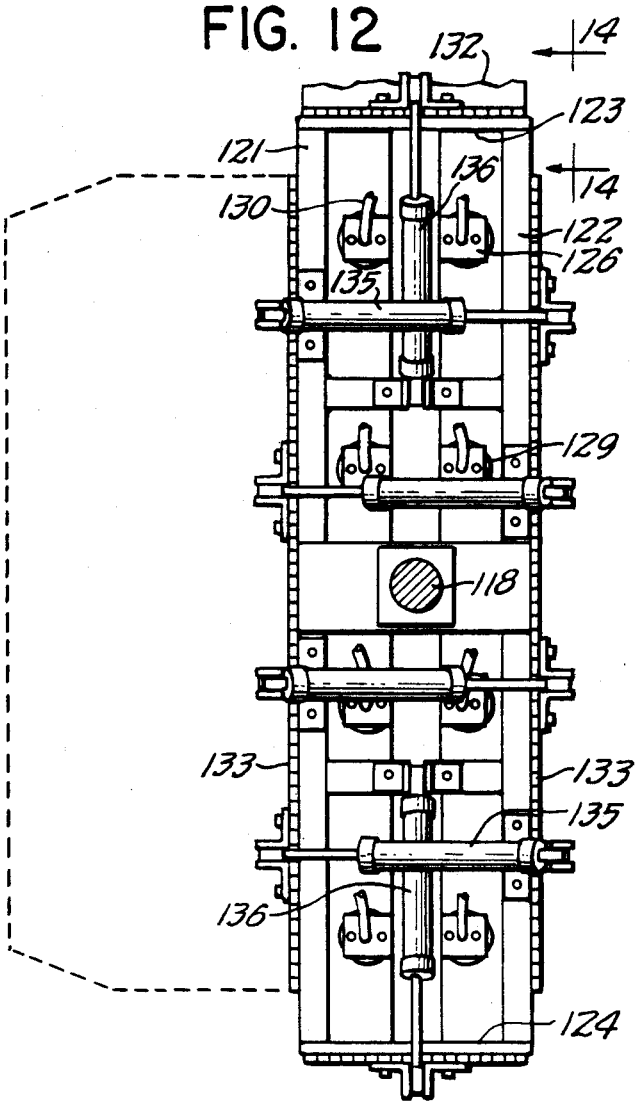
FIG. 12 is a top plan view of the gripper mechanism of FIG. 11.

In the illustration of FIG. 10, a standard bakery basket 11 is of a size and shape to receive three load groups of the packages 93, arranged side by side extending in a lengthwise direction. A similar product configuration in the basket could be achieved by utilizing load groups of three packages and placing four load groups transversely in the basket 11. This could have the disadvantage, however, of requiring an additional cycle of the robotic loader. In many cases, however, an optimum loading pattern may require loading certain load groups with a longitudinal orientation and others with a transverse orientation, in order to achieve most efficient utilization of the basket capacity for a given size and shape of product package. FIG. 15, for example, is illustrative of a possible loading pattern for loaves of bread, in which there are six loaves 120 positioned transversely and four longitudinally. For such a loading pattern, the product conveyor and gripper mechanism logically would be set up to operate with product load groups consisting of two loaves positioned side by side or perhaps four loaves, arranged two-by-two.

It will be appreciated that the gripper mechanism may be operated to pick up a group of product packages from the product conveyor and to deposit the packages in a basket in one or more load operations in a plurality of positions and/or orientations. For example, four packages might be picked up from the product conveyor, and then three deposited in the basket in one position and orientation and the fourth in a second location and perhaps a different orientation, in order to achieve a desired pattern loading.

In the initial programming of the loader 110 the loader may be manually jogged through its individual motions, with the motion coordinates being set by a programming control at the beginning and end of each motion sequence. Thereafter, the programmed series of movements are performed automatically in sequence by calling upon the steps stored in semi-permanent memory.

Pursuant to a further aspect of the invention, a novel gripper mechanism is provided, which enables reliable pickup and transfer of bagged product from the pick-up station, and which easily accommodates reconfiguration for a large variety of product load groups. As shown particularly in FIGS. 11–14, the gripper mechanism 119 includes a generally rectangular frame structure comprised of a pair of spaced tubular side members 121, 122 connected rigidly by end members 123, 124. The frame structure is rigidly secured to the end of the shaft 118 of the robotic loader 110, so as to be movable therewith. Desirably, the means of attachment (not shown) of the shaft 118 to the gripper frame structure are such as to accommodate relatively easy changeover of gripper mechanisms, as may be necessary or desirable to handle product load groups of significantly different configuration than that shown in FIG. 10, for example.

Secured rigidly to the frame and extending longitudinally from one end to the other is a downwardly opening support channel 125 which adjustably received a plurality of transversely disposed cross bars 126. By means of a screw 127 and threaded plate 128 (See FIG. 13), each cross bar may be secured in any longitudinal position along the support channel 125.

In the illustrated arrangement, each cross bar element 126 mounts a transversely spaced pair of downwardly projecting, bellows-like suction devices 129. The suction devices are formed of a very soft, plastic material, so as to be easily compressible in the vertical direction. They are open at their lower ends and are connected at their upper ends to individual suction lines 130. Each suction device has its own suction line, which is separately valved (valves not shown) so that the individual devices may be separately actuated as a function of various configurations of product load groups. In the specific mechanism of FIG. 12, for example, there are four cross bars 126, each positioned to overlie a product package 93 of a four-package load group.

Figure 11:
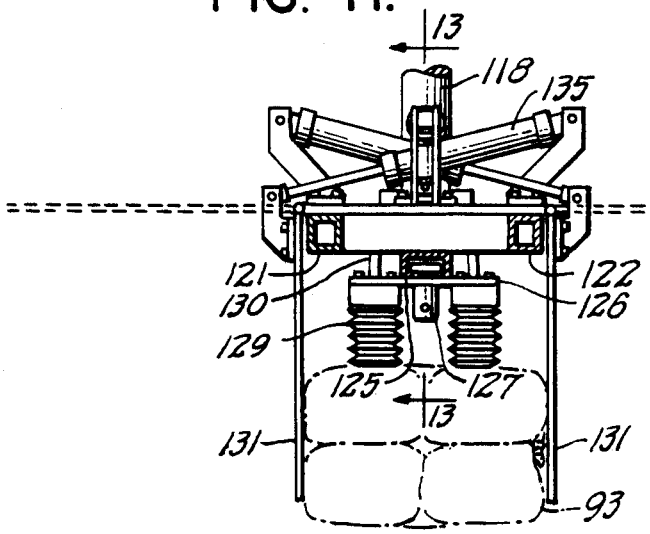
FIG. 11 is a cross sectional view of a product gripper mechanism according to the invention, shown gripping a package of bakery products.
Figure 13:
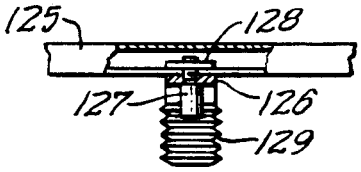
FIGS. 13 is a fragmentary cross sectional view taken generally along line 13—13 of FIG. 11.

In a product pick-up operation, the gripper mechanism is positioned over the load group and the suction devices 129 are lowered gently onto the tops of the packages, as shown in FIG. 11. Because there can be a significant degree of variability in the product packages, the suction devices 129 are initially pressed slightly into the product packages to assure that all devices are substantially in sealing contact. With suction being applied, the package material is drawn to the mouths of the suction devices to enable the devices to be picked up from the surface of the product conveyor.

It should be noted that the programmed control of the robotic loader easily accommodates selective actuation of suction valves for the various suction devices 129. Accordingly, in the course of a multiple stage pick-up and placement of product packages in the course of filling a single basket, the gripper mechanism may be operated to pick up or deposit less than a full load group in a given operation, in order to realize an efficient utilization of the space within the basket. This can be accomplished by controllably applying or releasing suction to selected ones of the lines 130 for selected operations.

As will be appreciated, with the product packages are picked up by the suction devices 129, the packages are suspended loosely from rather small areas of contact with the packages. Accordingly, large stresses would be placed on the suction-gripped areas of the packages when, after the pick-up, the gripper mechanism is rapidly accelerated through both rotational and translational motions to position the gripper properly over the basket being loaded. In a high speed production operation, loss of packages could well result.

To avoid excessive stresses from rapid gripper movements, without limiting the speed of operation of the equipment, the gripper mechanism of the invention incorporates retractable side and end flaps 131, 132, respectively, which are pivotally mounted along the outside edges of the frame elements 121–124 by means of hinges 133, 134, pressure actuators 135, 136 are mounted on the frame structure and are connected respectively to the side and end flaps 131, 132. The side flaps 131, by reason of their rather extended length, are each provided with a pair of actuators 135, as reflected in FIG. 12.

As indicated in FIG. 11, the flaps are raised to generally horizontal positions prior to the commencement of a pick-up operation at the pick-up station of the product conveyor. However, as soon as the product packages have been engaged and lifted off of the product conveyor, the flaps are pivoted vertically downward, so that the sides of the packages are confined within close limits. It is then possible for the gripper mechanism to undergo rather violent translational and rotational movements, to effect a high speed transfer of the packages, without the likelihood of throwing packages off of the gripper or causing them to become skewed or otherwise improperly oriented on the gripper mechanism.

After transfer of the loaded gripper mechanism to a position over the basket 11 being loaded, the flaps 131, 132 may be raised again, immediately prior to lowering the packages into the basket. In some cases it may be desirable to retain the flaps in their down positions during deposit of the packages, in order to laterally compress the packages somewhat if necessary to "stuff" them into the basket.

Figure 14:
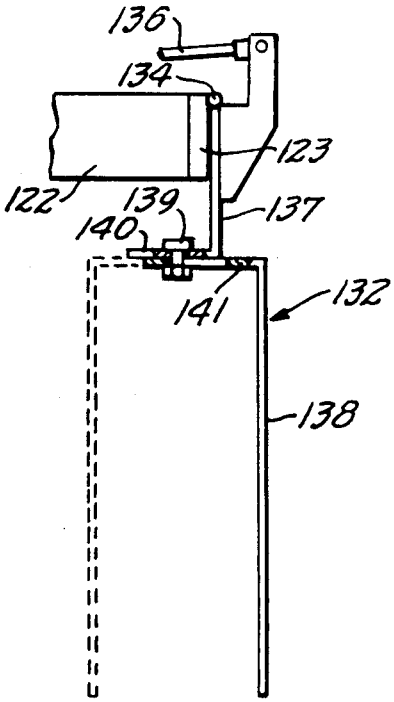
FIG. 14 is a fragmentary elevational view of the gripper mechanism, as viewed at 14—14 of FIG. 12.

FIG. 14 illustrates an advantageous construction of flaps, particularly for the end flaps 132. The flap is constructed of upper and lower parts 137, 138 secured together by bolts 139. The respective upper and lower parts are of L-shaped configuration, each having a horizontal flange portion 140 or 141 by which the two parts are secured with the bolts 139. Depending upon the orientation of the lower flap section 138, as shown in full and broken lines in FIG. 14, the effective length of the area confined between the end flaps 132 may be quickly made shorter or longer to more optimally suit a particular product load group configuration.

The process and apparatus of the invention represent a very significant advance in commercial bakery automation as applied to the loading of the packaged bakery products. Heretofore, this phase of bakery plant operation has been found very difficult to automate and has remained a labor intensive, costly phase of the procedure. Significant to the present invention is the ability to handle a wide variety of products that typically are produced in a conventional commercial bakery operation.

Particularly because of the unique arrangements of product conveyor mechanism and product gripper mechanism, it becomes possible to utilize to full advantage a commercially available robotic loader for effecting high speed, easily programmable transfer of the packaged bakery products to waiting shipping baskets. Moreover, the system of the invention accommodates the optimal pattern loading of the packaged products directly in the shipping basket, by enabling selective pick-up of bagged, boxed or otherwise packaged product from the product conveyor and various rotational orientation of the products as they are inserted into the shipping baskets.

The system of the invention also incorporates a particularly advantageous conveyor system and control therefor, whereby a single infeed conveyor for empty baskets can effectively supply baskets to a plurality of product load stations. By means of an special arrangement of secondary basket conveyor section and diverter means associated therewith, the individual load stations are kept supplied with by baskets on a demand basis while accommodating virtually continuous operation of the main infeed and discharge conveyors so that the overall system runs with a high degree of efficiency.

It should be understood, of course, that the specific forms of the invention herein illustrated and described is intended to be representative only, as certain changes may be made therein without departing from the clear teachings of the disclosure. Accordingly, reference should be made to the following appended claims in determining the full scope of the invention.

We claim:

1. A system for basket loading of packaged bakery products, which comprises (a) a primary basket conveyor line for supplying empty shipping baskets, (b) a plurality of product conveyors associated with said basket conveyor line for feeding pre-packaged products to a plurality of product pick-up stations adjacent said basket conveyor line, (c) a plurality of robotic loaders one associated with each of said product pick-up stations for engaging product packages and transferring said packages to a basket positioned at a loading position, (d) said loaders being arranged in a series along the path of said primary conveyor line, (e) each of said loaders having associated therewith a secondary conveyor section, (f) each said secondary conveyor section and the loader associated therewith forming a load station, (g) said primary conveyor line and each of said secondary conveyor sections including conveyor drive elements having a low-friction drive relationship with baskets supported thereon, (h) clamping means at each load station for engaging and holding stationary a basket positioned for loading at said station, while the conveyor section associated therewith continues to operate, (i) basket feed control means associated with each of said secondary conveyor sections for detecting when a secondary conveyor section should be supplied with one or more additional baskets, (j) means associated with each of said secondary conveyor sections and responsive to said basket feed control means for selectively diverting a basket from said primary conveyor line onto a secondary conveyor section, and (k) control means responsive to the filling of a basket with product at any loading position to effect release of the clamping means holding the basket at said loading position, whereby said filled basket is immediately removed by the conveyor section associated therewith.

2. Apparatus according to claim 1, further characterized by, (a) said primary conveyor line comprising a infeed section, for supplying empty baskets from a source thereof, and one or more intermediate conveyor sections driven in synchronism with said infeed section, and (b) said means for diverting including belt conveyor means interposed between said infeed conveyor section and an intermediate conveyor section and driven separately therefrom, (c) said belt conveyor means being adapted to have an effective gripping contact with said shipping baskets.

3. Apparatus according to claim 1, further characterized by, (a) each of the secondary conveyor sections comprising separate, independently driven conveyor sections, and (b) basket diverting means associated with at least each the secondary conveyor sections upstream of the last such conveyor section and operative, when actuated, to divert a basket from said primary conveyor line for supply to the associated upstream secondary conveyor section, (c) control means associated with each said upstream secondary conveyor sections for actuating the basket diverting means associated therewith.

(d) said control means including means for sensing the absence of a basket at a predetermined position associated with said secondary conveyor section for actuating said diverting means and directing a basket onto said secondary conveyor section.

4. Apparatus according to claim 3, further characterized by, (a) said secondary conveyor sections each comprising a load section, a staging section and a reservoir section, in sequence in a downstream-to-upstream direction, (b) basket sensing means in said reservoir section for sensing the absence of a basket at a predetermined position in said reservoir section and responsive thereto to actuate the basket diverting means for said conveyor section.

5. Apparatus according to claim 1, further characterized by, (a) each of said secondary conveyor sections comprising a discharge conveyor means for delivering filled baskets to a remote location.

6. Apparatus according to claim 1, further characterized by, (a) said secondary conveyor sections each comprising load sections, staging sections and reservoir sections, in sequence in a downstream-to-upstream direction, (b) load stop and clamping means at said load section for stopping and gripping a basket at a predetermined loading position, (c) first basket sensing means at said loading position responsive to a basket being conveyed to said load station to actuate said stop and clamping means for positioning said basket accurately at said loading position and for gripping said basket in said loading position, (d) stage clamp means at said staging section for gripping a basket positioned therein at a predetermined staging position, (e) second basket sensing means at said staging section for sensing the presence of a basket at said staging position for a predetermined time interval indicating a stopped basket to actuate stage clamp means for gripping the basket in said staging position, (f) said basket feed control means comprising third basket sensing means at said reservoir section for sensing the absence of a basket at a predetermined upstream location of said reservoir section and, in response thereto, causing a basket to be diverted from said primary conveyor line for said secondary conveyor section.

7. Apparatus according to claim 5, further characterized by, (a) said control means responsive to the filling of a basket being operative to effect timed, sequential release of said load clamp followed by said stage clamp.

* * * * *